US007213270B2

(12) United States Patent
Lee

(10) Patent No.: US 7,213,270 B2
(45) Date of Patent: May 8, 2007

(54) HEADBAND WITH INSERTED LINING TAPE FOR HEADWEAR

(75) Inventor: Jeong Sik Lee, Seoul (KR)

(73) Assignee: DADA Corp., Seoul (KR)

( * ) Notice: Subject to any disclaimer, the term of this patent is extended or adjusted under 35 U.S.C. 154(b) by 499 days.

(21) Appl. No.: 10/669,443

(22) Filed: Sep. 25, 2003

(65) Prior Publication Data

US 2005/0066419 A1 Mar. 31, 2005

(51) Int. Cl.
*A42B 1/00* (2006.01)

(52) U.S. Cl. ..... 2/195.1; 2/181; 2/175.1

(58) Field of Classification Search ..... 2/181, 2/195.1, 195.2, 195.3, 175.1, 184
See application file for complete search history.

(56) References Cited

U.S. PATENT DOCUMENTS 4,642,817 A 2/1987 Ferstenfeld
5,632,046 A 5/1997 Green et al.
5,915,534 A 6/1999 May
6,016,572 A 1/2000 Park
6,199,213 B1 * 3/2001 Whang ..... 2/181
6,895,601 B2 * 5/2005 Park ..... 2/181

* cited by examiner

*Primary Examiner*—Gary L. Welch
*Assistant Examiner*—Richale L. Haney
(74) *Attorney, Agent, or Firm*—Lowe Hauptman & Berner, LLP

(57) ABSTRACT

Headband for headwear having a crown portion, the headband being attached to and extending around the lower inside edge of the crown portion. The headband is made of fabric or knitted textile as a covering portion with a mesh lining tape inserted on the inside thereof. The covering portion and liner are sewn together, preferably with stretch yarn, in a chain-like pattern to provide excellent expandability without the need for a separate size controller. The mesh lining tape improves the ventilation provided through the headband, while also serving to retain the overall uniform shape of the crown portion of the cap when the cap is removed.

18 Claims, 2 Drawing Sheets

HEADBAND WITH INSERTED LINING TAPE FOR HEADWEAR

BACKGROUND OF THE INVENTION

1. Field of the Invention

The present invention is related to the field of headwear and, more particularly, to a headband with a mesh liner that provides improved elasticity, ventilation and shape-retaining performance to a cap.

2. Description of the Related Art

A baseball style cap generally includes a crown main body having a plurality of fabric panels, a visor portion that is secured to the forward edge of the crown and extends outwardly therefrom, and a headband attached to the lower part of the inside of the crown. A size controller may also be attached to an underside of the rear of the cap for adjusting the size of the cap to fit the wearer's head.

The visor portion typically provides shape retention to the adjacent portion of the crown main body, but the panels in the side and rear portions of the crown main body often droop, lacking sufficient support from the headband to retain a uniform shape around the full circumference of the crown main body. In addition, prior art headbands often fail to provide breathability or adequate elasticity, making the cap uncomfortable for the wearer.

Accordingly, a need exists for a headband to be used in headwear that is able to retain the cap's uniform shape, while providing excellent elasticity and ventilation.

SUMMARY OF THE INVENTION

In view of the foregoing, one object of the present invention is to provide headwear with a stretchable headband having a mesh liner for breathability.

Another object of the present invention is to provide a headband with a mesh liner having shape-retaining capability so as to maintain a cap in a uniform shape.

A further object of the present invention is to provide automatic size-adjusting headwear through a stretchable headband having a mesh liner that does not exert undue pressure on the head when worn.

Yet another object of the present invention is to provide a headband having a mesh liner for good wicking of moisture and drying of the headband.

In accordance with these and other objects, the present invention is directed to headwear having a crown portion and a headband attached to and extending around the lower inside edge of the crown portion. A visor part may also be attached to the underside of the crown portion. The headband is made with a fabric or knitted textile covering portion and a mesh lining tape portion. The covering portion and liner portion are sewn together in a chain-like pattern to provide good expandability and thereby increase the number of different wearer head sizes that may be accommodated by the headband without the need for a separate size controller. The mesh lining tape improves the ventilation provided through the headband for wearer comfort, while also serving to retain the overall uniform shape of the crown portion of the cap when the cap is not being worn.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
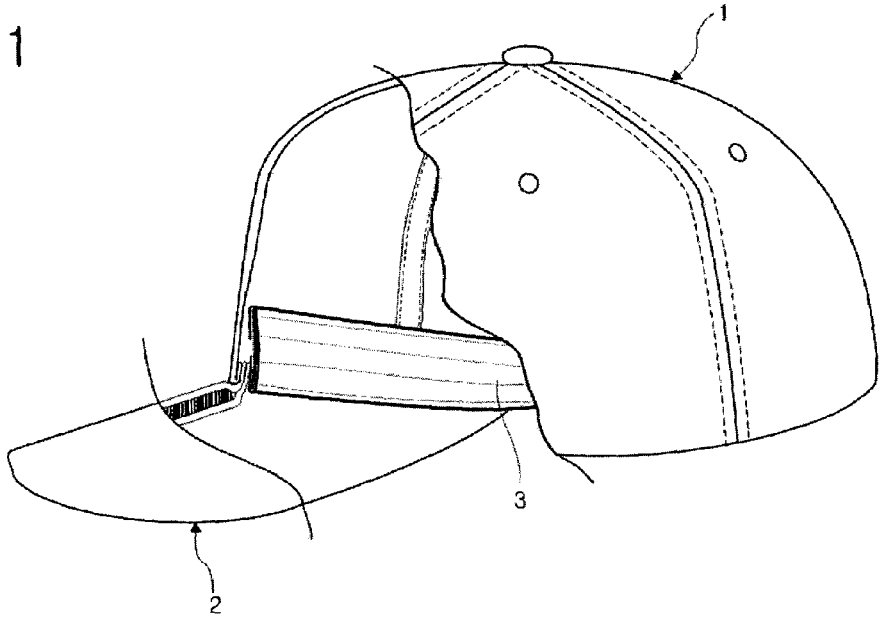
FIG. 1 is a partially sectioned view of a baseball-style cap with a headband according to the present invention.

In describing a preferred embodiment of the present invention illustrated in the drawings, it is to be understood that this embodiment is given by way of illustration only. It is not intended that the invention be limited in its scope to the details of construction and arrangement of components set forth in the following description or illustrated in the drawings. Also, in describing the preferred embodiment, specific terminology will be resorted to for the sake of clarity. It is to be understood that each specific term includes all technical equivalents which operate in a similar manner to accomplish a similar purpose.

The present invention is suitable for headwear of various types, but is described herein with reference to a baseball-style cap. As broadly illustrated in FIG. 1, the present invention as thus embodied includes a crown main body, generally designated by the reference numeral 1, a visor portion, generally designated by the reference numeral 2, and a headband, generally designated by the reference numeral 3. The crown part 1 is generally made of more than one piece of fabric, having a plurality of panels sewn adjacent one another. The visor portion 2 is secured to the forward edge of the crown main body 1, and the headband 3 is secured to the lower peripheral edge of the interior of the crown main body 1.

Figure 2:
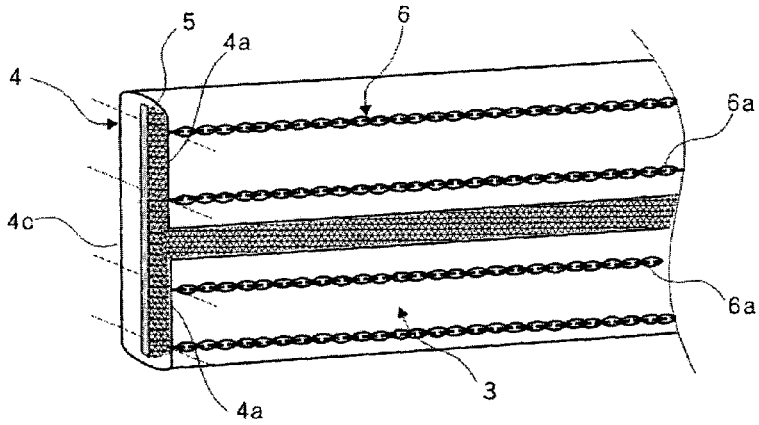
FIG. 2 is a perspective view of the headband sewn with mesh lining tape according to the present invention.

FIG. 2 illustrates the headband according to the present invention, generally designated by the reference numeral 3, shown from the inner side, with "inner" referring to that side of the headband contacting the inner surface of the lower edge of the crown part of the corresponding headwear, and being opposite that side which directly contacts the wearer's head when the headwear is worn. The headband is attached to the inner peripheral portion of the crown main body by stitching and may include a separate elastic member (not shown) along the joint between the crown and the headband.

As shown in FIG. 2, the headband 3 includes a covering portion, generally designated by the reference numeral 4, which may be made of fabric or hand-knitted textile, and may or may not contain polyurethane. The covering portion 4 is folded to have a generally tunnel-like shape, and a mesh lining tape 5 is inserted inside between the folded portions 4*a* and the unfolded portion 4*c*. The mesh lining tape 5 is secured within the folded fabric or textile 4 using a plurality of stitching lines 6 which are preferably constructed in a chain-like pattern using stretch yarn to provide improved automatic size adjustment to accommodate a wide range of head sizes.

The extent of the covering portion 4 that is folded over may vary. For example, the two folded portions 4*a* may nearly meet on the inner side, as shown in FIG. 2, or these portions may wrap over only the edges of the liner 5 and not extend to the level of the center stitching lines 6*a*. Accordingly, in a reduced-folding embodiment (not shown), the two center stitching lines 6*a* would pass through the liner 5 and the outer unfolded portion 4*c* of the fabric 4 only, but would not pass through the folded portions 4*a*.

Figure 3:
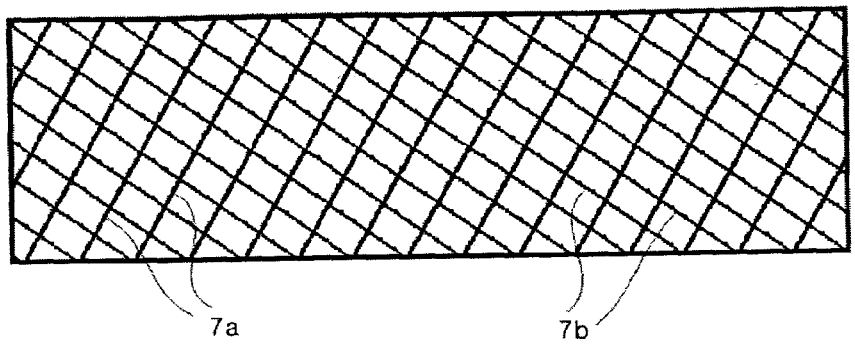
FIG. 3 is a close-up view of the mesh lining tape shown in FIG. 2.

The structure of the mesh lining tape 5 is illustrated in greater detail in FIG. 3. As shown, the mesh is formed by interwoven, substantially perpendicular strands 7*a*, 7*b*, made of mainly nylon yarn, and arranged on a bias. The resulting mesh lining tape formed by the interwoven strands is thin and light, and may be readily stretched in the direction of the periphery of the crown part 1 to accommodate various head sizes.

Due to the structural shape and inherently "wiry" nature of the mesh of nylon strands, the liner portion of the headband acts to maintain the uniform shape of the cap, particularly with respect to the side and rear panels of the crown main body 1, by providing structural support thereto. This support remains effective even when the user of the cap wears and removes the cap repeatedly. Because the nylon in the mesh has inherent shape retention, when the cap is taken off there is no need for any manual shaping of the side and rear panels of the crown main body by the user to retain the cap's uniform and attractive appearance. Furthermore, this shape retaining function also makes it easier to put the cap back on, as the crown main body does not droop or collapse but remains properly shaped for wear.

The mesh form of the liner also allows air to flow freely within the headband, making the headwear cooler to wear and thus reducing the amount of sweat generated. The enhanced ventilation also allows the headband to dry more rapidly.

As set forth herein, it may be seen that the headband according to the present invention, with its controlled elasticity, provides excellent automatic size-adjusting capability for free-size headwear, i.e., for headwear that does not include a separate size controlling portion apart from the headband. In addition, the headband may also be used advantageously with headwear that does include a separate size controlling portion, as the inventive headband also provides improved ventilation and excellent structural support to the crown portion of any cap to prevent drooping, maintain attractive appearance and facilitate ease of cap use.

The foregoing descriptions and drawings should be considered as illustrative only of the principles of the invention. The invention may be configured in a variety of shapes and sizes and is not limited to the specific construction of the preferred embodiment. Numerous applications of the present invention will readily occur to those skilled in the art. For example, the headband may be incorporated into hats, caps and visors of other styles. Therefore, it is not desired to limit the invention to the specific example disclosed or the exact construction shown and described. Rather, all suitable modifications and equivalents may be resorted to, falling within the scope of the invention.

What is claimed is:

1. Headwear comprising: a crown main body; and a headband attached along a lower peripheral edge of said crown main body, said headband including a covering portion and a mesh lining tape sewn together with a plurality of stitching lines interwoven in a chain-like pattern, wherein said mesh lining tape is made of nylon yarn interwoven to form a mesh of generally perpendicular strands arranged on a bias.

2. The headwear as set forth in claim 1, wherein said covering portion is folded over at least part of said mesh lining tape.

3. The headwear as set forth in claim 1, wherein said stitching lines are sewn with stretch yarn.

4. The headwear as set forth in claim 1, wherein said covering portion is made of fabric.

5. The headwear as set forth in claim 1, wherein said covering portion is made of hand-knitted textile.

6. The headwear as set forth in claim 5, wherein said hand-knitted textile contains polyurethane.

7. The headwear as set forth in claim 5, wherein said hand-knitted textile contains no polyurethane.

8. The headwear as set forth in claim 1, wherein said covering portion has a tunnel-like shape with folded portions overlapping said mesh lining tape.

9. The headwear as set forth in claim 8, wherein said stitching lines are sewn with stretch yarn and extend through said covering portion including said folded portions.

10. A free-size headband comprising a covering portion and a mesh lining tape sewn together with a plurality of stitching lines interwoven in a chain-like pattern, the mesh lining tape being made of nylon yarn interwoven to form a mesh pattern of generally perpendicular strands arranged on a bias.

11. The headwear as set forth in claim 10, wherein said covering portion is folded over at least part of said mesh lining tape.

12. The headwear as set forth in claim 10, wherein said stitching lines are sewn with stretch yarn.

13. The headwear as set forth in claim 10, wherein said covering portion is made of fabric.

14. The headwear as set forth in claim 10, wherein said covering portion is made of hand-knitted textile.

15. The headwear as set forth in claim 14, wherein said hand-knitted textile contains polyurethane.

16. The headwear as set forth in claim 14, wherein said hand-knitted textile contains no polyurethane.

17. The headwear as set forth in claim 10, wherein said covering portion has a tunnel-like shape with folded portions overlapping said mesh lining tape.

18. The headwear as set forth in claim 17, wherein said stitching lines are sewn with stretch yarn and extend through said covering portion including said folded portions.

* * * * *